US005724757A

United States Patent [19]

Warden

[11] Patent Number: 5,724,757

[45] Date of Patent: Mar. 10, 1998

[54] INDEX CARDS FOR ORGANIZING AUDIO OR VIDEO MEDIA CONTAINERS

[76] Inventor: Ronald William Warden, P.O. Box 835, Gold Beach, Oreg. 97444

[21] Appl. No.: 544,324

[22] Filed: Oct. 17, 1995

[51] Int. Cl.[6] ..... B42F 21/00

[52] U.S. Cl. ..... 40/360; 40/641; 206/308.1; 206/425; 211/41.12; 312/234.4

[58] Field of Search ..... 40/360, 641; 312/234.1, 312/234.4; 206/425, 459.5, 308.1; 211/41.12

[56] References Cited

U.S. PATENT DOCUMENTS

| | | | |
|---|---|---|---|
| 478,617 | 7/1892 | Lodwick | 40/360 X |
| 730,399 | 6/1903 | Rand | 40/641 X |
| 1,128,044 | 2/1915 | Rand et al. . | |
| 1,248,910 | 12/1917 | Rand | 40/641 X |
| 1,253,629 | 1/1918 | Read . | |
| 1,294,948 | 2/1919 | Rand . | |
| 1,423,206 | 7/1922 | Geddes . | |
| 1,435,036 | 11/1922 | Weis . | |
| 1,914,671 | 6/1933 | O'Neil | 40/641 |
| 3,112,966 | 12/1963 | Reid . | |
| 3,164,430 | 1/1965 | Beem et al. | 312/234.4 |
| 3,324,823 | 6/1967 | Peters | 40/360 X |
| 4,119,200 | 10/1978 | Cassidy et al. . | |
| 4,190,151 | 2/1980 | Russell | 40/360 X |
| 4,232,461 | 11/1980 | Crawford . | |
| 4,236,768 | 12/1980 | Morrone | 312/234.1 X |
| 4,330,060 | 5/1982 | Thornton | 206/459.5 |
| 4,519,500 | 5/1985 | Perchak | 206/459.5 X |
| 4,630,385 | 12/1986 | Swim | 40/340 |
| 4,932,522 | 6/1990 | Milovich | 206/308.1 |
| 4,971,195 | 11/1990 | Mitsuyama | 206/308.1 X |
| 4,978,005 | 12/1990 | Sammet . | |
| 5,048,208 | 9/1991 | Tatz | 40/312 |
| 5,076,490 | 12/1991 | Dulin | 40/360 X |
| 5,097,946 | 3/1992 | Emrich | 206/308.1 X |
| 5,135,261 | 8/1992 | Cusack et al. . | |
| 5,249,827 | 10/1993 | Olson . | |
| 5,558,220 | 9/1996 | Gartz | 206/308.1 |

OTHER PUBLICATIONS

Compact Disk Divider Entitled "DiscPickables™" 1994.

*Primary Examiner*—Anthony Knight
*Assistant Examiner*—Andrea Chop
*Attorney, Agent, or Firm*—Klarquist Sparkman Campbell Leigh & Whinston LLP

[57] ABSTRACT

An index card sized to be wedged within the slots of a storage case for organizing audio or video media containers such as CD jewel boxes or the like. In the preferred embodiment of the invention, a card body is sized to be coextensive with a container. A tab or index element projects outwardly from the card body so that identifying information can be placed thereon. The card body also contains a locking member to lock the index card within the storage device so that the media container can be removed without disturbing the orientation of the index card. The locking member may also be used to allow the index card to be freestanding.

8 Claims, 2 Drawing Sheets

FIG. 1
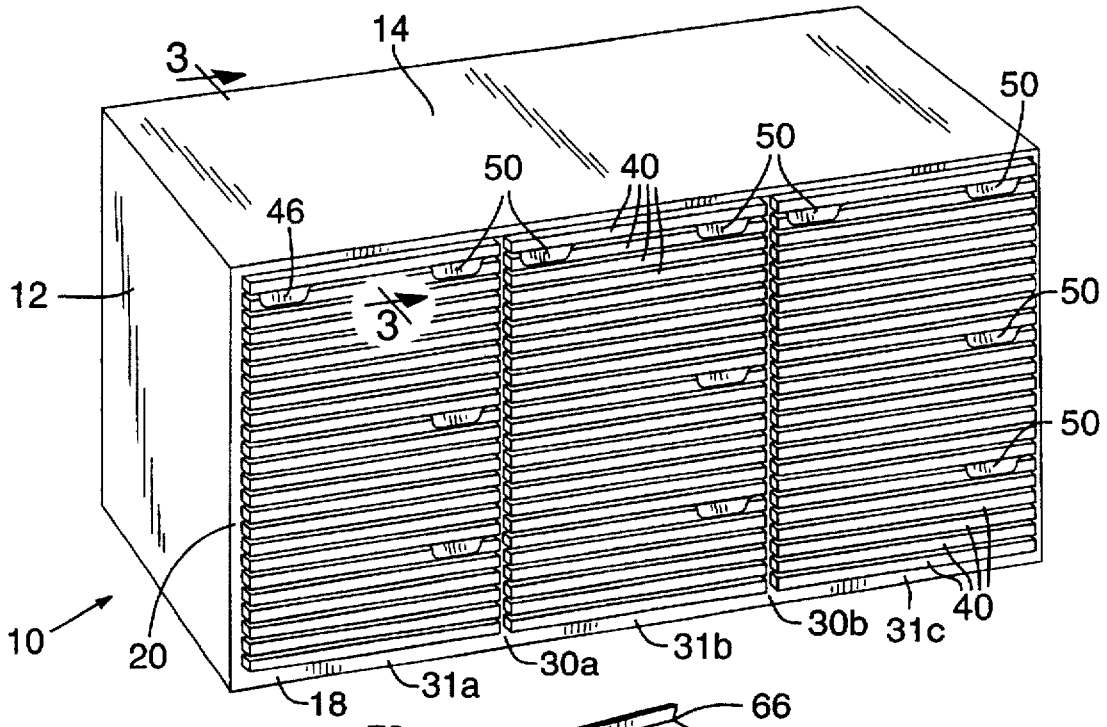
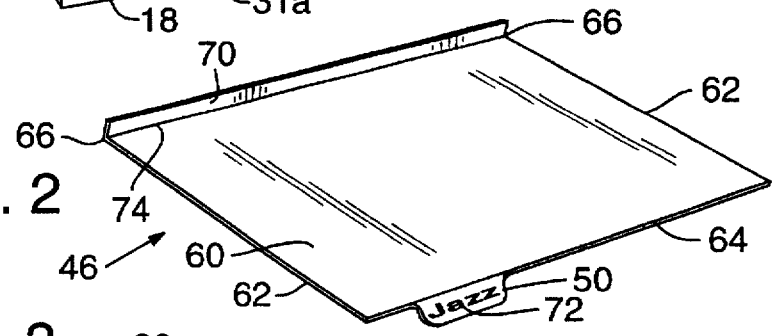
FIG. 2
FIG. 3
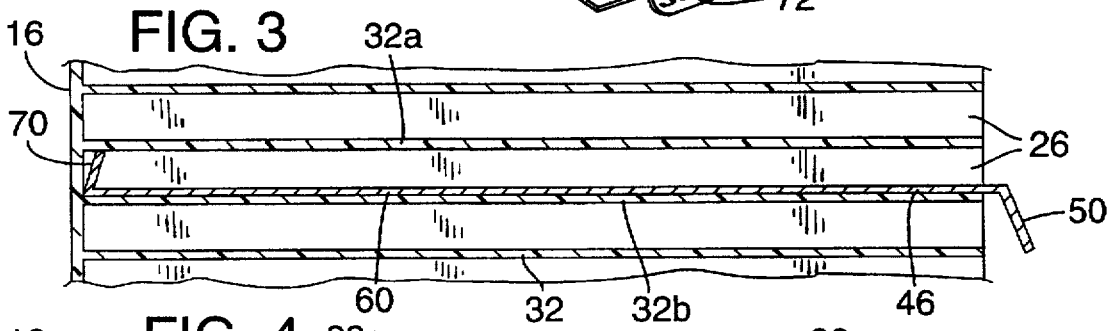
FIG. 4
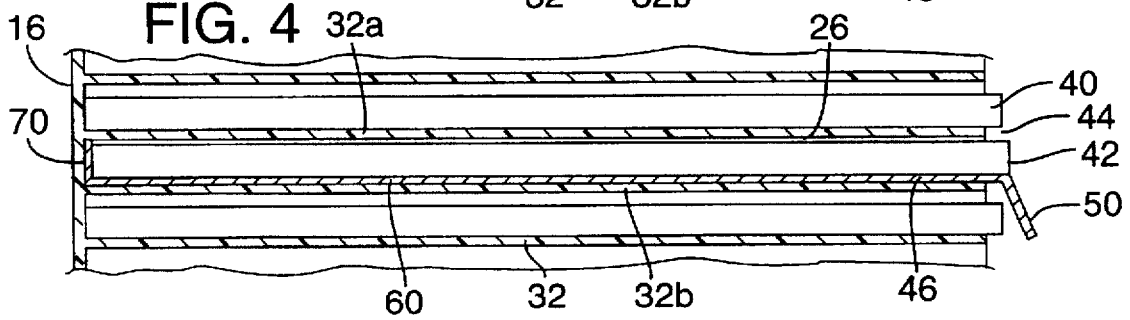

INDEX CARDS FOR ORGANIZING AUDIO OR VIDEO MEDIA CONTAINERS

FIELD OF THE INVENTION

This invention relates generally to index cards, and, more particularly, to an index card adapted for organizing audio or video media, such as CD ROMs, compact discs, video discs, video tapes and audio tapes.

BACKGROUND OF THE INVENTION

Audio or video media are generally stored in cases or containers designed to protect the media. For example, compact discs are stored in narrow containers known as jewel boxes. The containers usually have the title and other identifying information located along the container's spine. This arrangement allows a media container to be identified when stacked with other containers. Unfortunately, easy identification is often difficult because any print along the spine must be fine (typically one-eighth of an inch) to fit the limited space. Future containers will undoubtedly provide even less space as smaller media such as two and one-half inch discs become more popular.

The identification problem is compounded when one has dozens or hundreds of video or audio media to sift through in order to find a desired work. Storage devices (generally called organizer towers) are available to organize the media, and they typically include a number of slots in which individual containers may be inserted with their spines visible for reading. The slots may either be arranged vertically or horizontally. The storage devices vary in size, but typically are from three to six feet in length. Highly portable storage devices are also available for storing containers in vehicles.

But storage devices solve only part of the problem. The spines are still difficult to read, and one must still spend considerable time reading individual titles to find a desired work. Even if one organizes the works in some fashion, such as alphabetically or by subject matter, to minimize the search process, one must still squint at a multitude of spines. Additionally, some users may find containers particularly difficult to read when a container is at the top or bottom of a six-foot tall storage device.

Several attempts have been made to organize media containers within a storage device by structures such as those disclosed in U.S. Pat. Nos. 5,249,827 and 4,232,461. These structures and other prior devices typically have an index tab with an adhesive strip thereon. The tab adheres to an end of the media container so as to protrude from the storage device. A tab can, for example, have the letter "A" to indicate the beginning of a set of artists or titles starting with that letter.

These devices, however, are inconvenient for those who continually purchase additional works for updating or expanding their collection. Tabs must be removed and discarded from containers to make room for the newly purchased works. Some prior devices purposely form an extremely strong bond between the tab and container so that the tab can act like a handle to remove the container from the storage device. In such a case, tab removal can be exceptionally difficult. Even in the case when the tab is easily removed, however, a trace of adhesive may be left on the container.

An objective of the invention, therefore, is to provide a reusable index device that permits simple organization and search of a collection of audio or video media such as CDs and tapes. Another objective of the invention is to provide such a device that need not attach to media containers, but may be used with a container storage device such as a tower or portable case. A further objective is to provide an index card which can be more simply read at a desired angle relative to the tower or case.

SUMMARY OF THE INVENTION

The present invention relates to an index card which can be used to organize audio or video media containers without adhering to the container or a storage device and that works with many different types of storage devices. The index card is also durable and can be reused indefinitely. Additionally, the index card is visible from various selected angles.

In a preferred embodiment, an index card according to the invention includes a card body sized to be substantially coextensive with a media container. A tab projects outwardly from a front edge of the card body beyond the media container so that identifying information can be placed thereon. A locking member is joined to the card body for locking the index card in a storage device.

The index card may contain other features if desired. For example, the tab can extend downwardly from the card body at an oblique angle such as forty-five degrees. This allows the index card to be reversible, so that the tabs can be seen at various selected angles relative to the storage device. Additionally, the locking member can be a lip extending from the rear edge of the card body sized to wedge within a slot of a storage device.

The index card has several advantages over the prior devices. For example, when a container in contact with the index card is pulled from a storage device, the index card remains in place. Alternatively, if the containers are stacked vertically, when the container is removed, the index card may be freestanding to allow the container to be easily reinserted. Additionally, the index card is reusable and inexpensive to produce.

These features and others of the present invention will be more readily apparent from the following detailed description of a preferred embodiment which proceeds with reference to the accompanying drawings.

BRIEF DESCRIPTION OF THE DRAWINGS

FIG. 1 is a isometric view of a slotted storage device having index cards according to the invention and compact disk containers disposed within the slots.

FIG. 2 is an enlarged isometric view of an index card in FIG. 1 with exemplary markings placed on a tab.

FIG. 3 is a fragmentary side view of the slotted storage device of FIG. 1 showing the index card seated within a slot prior to the insertion of a compact disk container.

FIG. 4 is a fragmentary side view of the slotted storage device of FIG. 3 showing the compact disk inserted into the slot with the index card.

DETAILED DESCRIPTION OF THE PREFERRED EMBODIMENT

Figure 5:
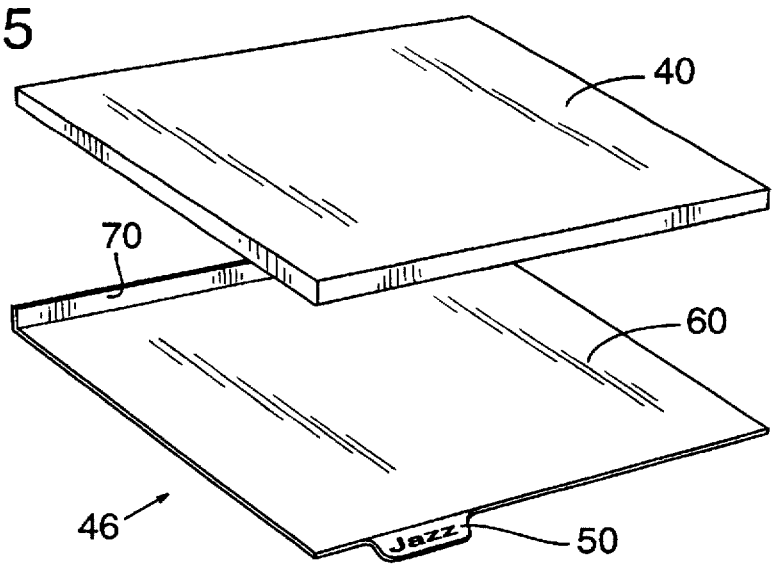
FIG. 5 is an isometric view of a compact disc container in its relation to an index card.

Referring to FIGS. 1, 3 and 4, a storage device 10 is a hollowed rectangular-shaped case having sides 12, a top 14, a back 16, a bottom 18, and a front face 20. Front face 20 is open exposing three columns 31*a*, 31*b*, and 31*c* of slots 26. Two vertical walls 30*a* and 30*b* extend from top 14 to bottom 18 to define the width of slots 26 and to partition front face 20 into the three columns. The width of slots 26 is defined by vertical walls 30*a*, 30*b*, and sides 12. Flanges 32 (FIGS. 3 and 4) project inwardly from vertical walls 30*a* and 30*b* and sides 12. The height of slots 26 is defined by the distance between top and bottom flanges, such as top flange 32*a* and bottom flange 32*b* seen in FIG. 3.

Compact disk containers 40 are shown inserted in slots 26. The containers have a rear edge or spine 42 upon which the work's title and artist appear in print. Flanges 32 separate and form a gap 44 between containers 40 to aid in the removal of the containers from slots 26. Index cards 46 are inserted into selective slots 26 with containers 40. Index cards 46 are sized to allow both a container and an index card to fit within a single slot (best shown in FIG. 4). An index element or tab 50 projects outwardly from the body of the card beyond spine 42 of container 40 and has identifying markings (not shown) printed thereon. The markings may be of any form but preferably are letters for alphabetizing the artists or subjects of the media stored in containers 40 preferably, subject matter tabs 50 project from the left side of index card 46, while letter tabs 50 project from the right side. Such configurations are shown in FIG. 1.

FIG. 2 shows an index card 46 having a substantially planar card body 60 with sides 62, front edge 64, and rear edge 66. A locking member 70 is joined to rear edge 66. A tab 50 is joined to front edge 64 and projects therefrom near a side 62. The tab is shown with identifying information 72 to characterize the media within the container, the information being the word "jazz" to indicate the beginning of a jazz section.

Index card 46 is preferably made from plastic, such as a polycarbonate sheet manufactured by General Electric Lexan®. It will be readily apparent to one skilled in the art, however, that the card body can be made from a wide variety polymeric organic materials, such as, without limitation, polycarbonates, polyalkyl or alkylene compounds. The card can also be made from styrene, acrylic, plastic-coated paper or any other plastic-like materials.

The size of card body 60 is substantially coextensive to the size of media container 40 with which it is used. For example, in the illustrated example, the card body would have a length and width roughly equal to that of the compact disk container though the body need not be continuous. Corresponding configurations would be used for containers holding other media such as video tapes and audio tapes. The thickness of the card body 60 is preferably 10 mils or less to allow media container 40 and index card 46 to fit into the same slot, such as slot 26. The preferred thickness provides sufficient lateral stiffness of the index card to prevent card body 60 from sagging into slot 26 immediately beneath, while allowing container 40 and index card 46 to simultaneously nest in slot 26.

The locking member 70 is operatively connected to rear edge 66 of card body 60. The term "operatively connected" or "joined" means that the locking member can be integral with the card body or the card body and locking member can be separate pieces which are attached or bonded together. In the preferred embodiment, locking member 70 and card body 60 are integral.

Locking member 70 is preferably a lip extending between sides 62 and projecting from card body 60. Typically, lip 70 extends at an acute angle from card body 60, but the lip is capable of being substantially perpendicular to the card body, as is more clearly shown in FIG. 4. The lip also provides lateral rigidity to index card 46 so that the card can support itself in a slot 26 without the aid of a container 40.

Locking member 70 is preferably formed from a cold bend at joint 74 in plastic card 60. This allows lip 70 to bend from an acute angle to the substantially perpendicular position just described without weakening index card 46 at the joint.

FIG. 3 shows index card 46 seated within an empty slot 26 prior to being locked in place, and FIG. 4 shows the index card locked in the slot with compact disc container 40. Slot 26 is shown formed by top flange 32*a* and bottom flange 32*b*. The distance between these flanges is the height of slot 26. Lip 70 is of a height substantially equal to the height of slot 26 so that the lip can be wedged between the top and bottom flanges to lock index card 46 in the slot. In the case where the height of card lip 70 is slightly greater than that of the slot, the lip will deform with notches (not shown) forming in the lip to conform to the slot height.

Tab 50 projects from card body 60 at a downward oblique angle, preferably this angle is 45 degrees to allow a convenient view of the tab markings while allowing easy removal of the media container in the same slot or the adjacent slot below the index card. Other angles are of course possible or, alternatively, tab 50 can be in the same plane as card body 60.

Figure 6:
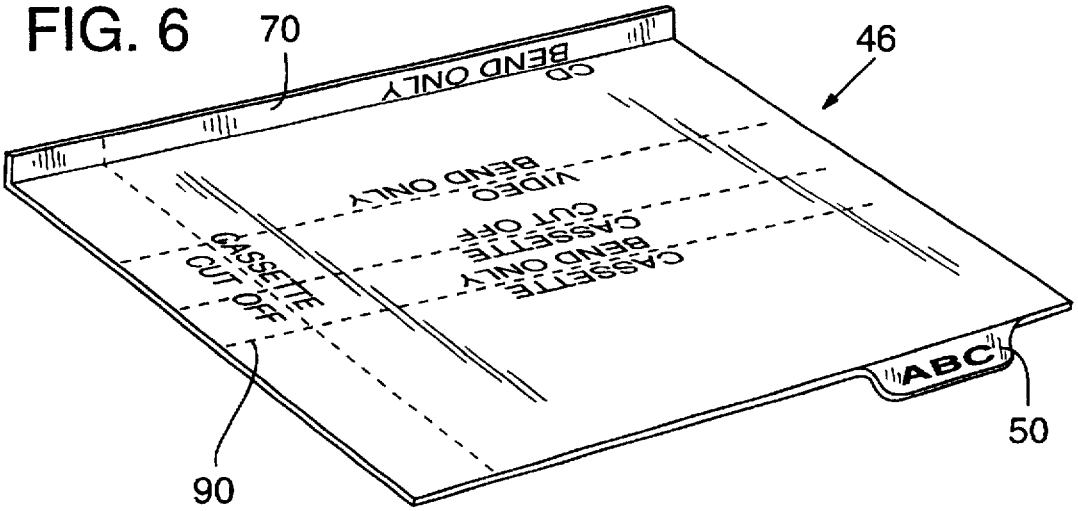
FIG. 6 shows an isometric view of an index card adaptable for different-sized media containers.

FIG. 6 shows an embodiment of index card 46 with cuttable lines 90 thereon to allow a user to size the index card to a desired media container. The cuttable lines can be perforated if desired to allow the removal of unwanted portions. Once index card 46 is cut to the proper size, the user can then crease the index card along the properly marked outline to form locking member 70.

To properly lock index card 46 in slotted tray 10, the index card should first be placed in a slot 26 with lip 70 pointing in the direction of the top flange such as flange 32a in FIG. 3. A media container 40 is then placed on top of the index card and inserted completely into slot 26 as is shown in FIG. 4. When container 40 contacts lip 70 of index card 46 it will push the lip into a roughly perpendicular position and drive card 60 into its proper place. The top of lip 70 is wedged into the slot locking the card in place.

Figure 7:
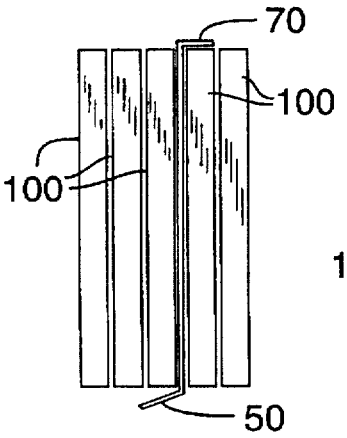
FIG. 7 is a top view of the index card seated between vertically aligned compact disks containers with the index card having the tab at a first selected angle.

FIG. 7 shows another application of index card 46. The index card is seated between compact disks 100 stacked vertically together. Tab 50 protrudes from the spine of the compact disks and is angled to the left. This allows viewers from the right side of the compact disks to easily view the tab.

Figure 8:
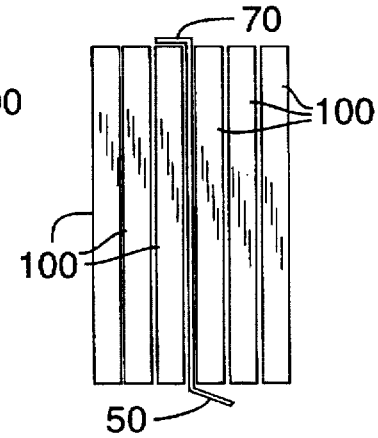
FIG. 8 is a top view of the index card seated between vertically aligned compact disks containers with the index card having the tab at a second selected angle.

FIG. 8 shows a similar configuration to that of FIG. 7, except the index card 46 is reversed so that the tab portion is angled to the right allowing viewers from the left side of the compact disks to easily view the tab. Thus, the reversible nature of the index card allows a user of the index card to choose which direction the tab will be optimally viewed.

Additionally, if the containers are stacked horizontally, as in FIG. 1, the index card can be placed so that tab 50 is pointing down or up according to the desired vertical viewing angle.

Figure 9:
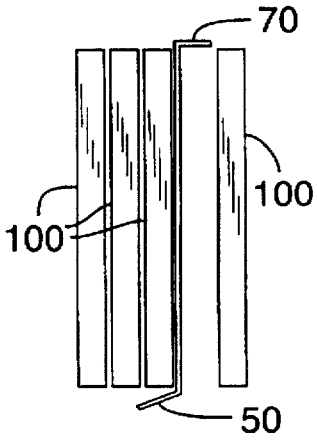
FIG. 9 is a top view of the index card of FIG. 7 with the compact disk container previously adjacent to the index card removed and the index card freestanding.

FIG. 9 shows a similar configuration as that in FIG. 8 with a compact disk container previously adjacent to the index card removed. The index card uses lip 70 to support itself. This allows easy replacement of the compact disk without having to make an adjustment of the index card.

Having described and illustrated the principles of my invention with reference to preferred embodiments thereof, it will be apparent that these embodiments can be modified in arrangement and detail without departing from the principles of the invention. For example, while the locking member was shown as a lip along the rear edge of the index card, other locking mechanisms are possible. For example, the index card could have a lip attached to each side of the card body extending perpendicularly therefrom to lock the index card in the slot.

Additionally, although the media containers shown are for compact disks, the invention can be used with a wide variety of containers. The index card is simply appropriately sized to be substantially coextensive with the container. Currently, the index card has been adapted for audio tape containers, video tape containers and compact disk containers. The index card can also be appropriately sized for any future containers, when they are realized, as one skilled in the art will understand.

In view of the wide variety of embodiments to which the principles of our invention can be applied, it should be apparent that the detailed embodiments are illustrative only and should not be taken as limiting the scope of my invention. Rather, I claim as my invention and all such modifications as may come within the scope of the following claims and equivalence thereto.

I claim:

1. An index card for organizing compact disc containers, audio tape containers, and video tape containers to be stored in a stack relationship, the index card comprising:

a card body having a front edge, a side edge, and a rear edge, wherein the card body is sufficiently large to extend between the front edge and the rear edge or the side edge of one of the containers;

a viewable tab extending outwardly from the front edge of the card body to a sufficient distance that the viewable tab extends beyond the container, wherein the viewable tab can be read between adjacent containers a retainer lip inclined at an angle from the side edge or rear edge of the card body, wherein the lip is sufficiently spaced from the front edge of the card body to fit against an edge of the container when the index card is placed against the container with the viewable tab extending outwardly from the front edge of the card body; and a storage device having a plurality of slots, and the index card is positioned within at least one of the slots of the storage device, with the viewable tab extending outwardly from the slot such that the viewable tab can be viewed when a container is stored in the slot, and the lip extends across the slot to wedge the index card in the slot.

2. The index card of claim 1, wherein the container is a compact disc container.

3. A device for organizing media containers, comprising:

a storage device comprising a plurality of slots, each slot configured to receive at least one of the media containers;

an index card within one or more of the slots, wherein each slot has a front edge, and the index card has a card body with a front edge, a rear edge, and a side edge;

a viewable index tab extending outwardly from the front edge of the card body, beyond the front edge of the slot in which the card body is contained, the viewable tab extending a sufficient distance that the tab can be viewed when a media container is present in the slot in which the card body is contained; and a retainer lip extending away from the card body along a side or rear edge of the media container, the retainer lip extending a sufficient distance from the card body to wedge the index card within the slot.

4. A device for organizing media containers, comprising:

a plurality of media containers stored next to one another in a stack;

a divider comprising a card body interposed between first and second media containers in the stack, and a viewable tab extending from the card body between the first and second containers; and a retainer lip inclined to the card body and engaging either the first or second container.

5. The device of claim 4, wherein the viewable tab is inclined at a right angle to the card body.

6. The device of claim 5, wherein the card body has opposing front and rear edges, and the viewable tab extends from the front edge of the card body, and the retainer lip extends from the rear edge of the card body.

7. The device of claim 5, wherein the first and second media containers are stored in slots of a storage device.

8. A device for organizing containers selected from the group consisting of compact disc containers, audio tape containers and video tape containers, the device comprising:

first and second containers stored in side-by-side aligned relationship;

a divider comprising a card body interposed between the first and second containers, the divider having a front edge and a rear edge;

a viewable tab extending from the front edge of the divider, inclined with respect to the card body, that can be viewed when the containers are stored in side-by-side relationship; and a retainer lip extending from the rear edge of the card body at a right angle, and extending along an edge of the container.

* * * * *